US008143560B2

(12) United States Patent
Park et al.

(10) Patent No.: US 8,143,560 B2
(45) Date of Patent: Mar. 27, 2012

(54) COOKING APPARATUS

(75) Inventors: Hyoung-jun Park, Busan (KR); young-min Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 1134 days.

(21) Appl. No.: 11/853,903

(22) Filed: Sep. 12, 2007

(65) Prior Publication Data

US 2008/0156202 A1 Jul. 3, 2008

(30) Foreign Application Priority Data

Sep. 12, 2006 (KR) ..... 10-2006-0088290

(51) Int. Cl.
*H05B 6/64* (2006.01)

(52) U.S. Cl. ..... 219/757; 219/704; 219/494; 126/299 R

(58) Field of Classification Search ..... 219/757, 219/756, 681, 400, 704, 494; 126/21 A, 126/299 R, 299 D
See application file for complete search history.

(56) References Cited

U.S. PATENT DOCUMENTS

| | | | | |
|---|---|---|---|---|
| 3,088,453 | A | | 5/1963 | Grahn et al. |
| 3,576,417 | A | | 4/1971 | Tingley |
| 3,654,417 | A | | 4/1972 | Javes et al. |
| 3,882,843 | A | | 5/1975 | Barnett |
| 3,911,893 | A | | 10/1975 | Baker et al. |
| 3,973,551 | A | | 8/1976 | Caselani et al. |
| 4,096,369 | A | | 6/1978 | Tanaka et al. |
| 4,132,878 | A | | 1/1979 | Tachikawa et al. |
| 4,184,945 | A | | 1/1980 | Morgan et al. |
| 4,255,640 | A | * | 3/1981 | Bressler ..... 219/704 |
| 4,327,274 | A | | 4/1982 | White et al. |
| 4,559,428 | A | | 12/1985 | Takeuji |
| 4,591,683 | A | | 5/1986 | Eke |
| 4,598,689 | A | | 7/1986 | Eke |
| 5,204,503 | A | | 4/1993 | Maiellano et al. |
| 5,525,782 | A | | 6/1996 | Yoneno et al. |
| 5,634,961 | A | | 6/1997 | Gordon |
| 5,674,425 | A | | 10/1997 | Hong |
| 5,814,793 | A | | 9/1998 | Yu |

(Continued)

FOREIGN PATENT DOCUMENTS

CN 1142037 2/1997

(Continued)

OTHER PUBLICATIONS

U.S. Office Action issued in U.S. Appl. No. 11/848,551 dated Dec. 21, 2010.

(Continued)

*Primary Examiner* — Quang Van
(74) *Attorney, Agent, or Firm* — KED & Associates, LLP

(57) ABSTRACT

A cooking apparatus is provided. The cooking apparatus includes a cooking cavity, a door, an input selection device provided on an exterior of the door, and a control panel provided in the door and operably coupled to the input selection device. The input selection device may include buttons which are illuminated by a light source provided with the control panel. A guide may be positioned between the control panel and the input selection device to guide the light generated by the light source to the input selection device and concentrate light on the buttons to illuminate the buttons. In this manner, the cooking apparatus may include a selection device on its door including buttons that are effectively illuminated.

19 Claims, 5 Drawing Sheets

U.S. PATENT DOCUMENTS

| | | | | |
|---|---|---|---|---|
| 5,818,015 | A | 10/1998 | Lee et al. | |
| 5,847,377 | A | 12/1998 | Yang et al. | |
| 5,994,683 | A | 11/1999 | Braunisch et al. | |
| 6,621,058 | B1 | 9/2003 | Kim | |
| 6,984,811 | B2 | 1/2006 | Lee | |
| 6,987,252 | B2 | 1/2006 | Graves et al. | |
| 7,019,272 | B2 | 3/2006 | Braunisch et al. | |
| 2001/0009256 | A1 | 7/2001 | Nasu et al. | |
| 2003/0116415 | A1 * | 6/2003 | Ardrey et al. | 200/56 R |
| 2003/0218011 | A1 | 11/2003 | Jeong | |
| 2004/0082367 | A1 | 4/2004 | Nakanishi | |
| 2005/0023277 | A1 | 2/2005 | Kim et al. | |
| 2005/0223912 | A1 | 10/2005 | Kim et al. | |
| 2006/0157481 | A1 | 7/2006 | Oh et al. | |
| 2006/0278216 | A1 | 12/2006 | Gagas et al. | |

FOREIGN PATENT DOCUMENTS

| | | | |
|---|---|---|---|
| CN | 1309266 | | 8/2001 |
| CN | 1528106 | | 9/2004 |
| CN | 1697898 | | 11/2005 |
| CN | 1752532 | A | 3/2006 |
| CN | 1769801 | | 5/2006 |
| DE | 38 39 657 | | 5/1990 |
| EP | 0 248 580 | | 12/1987 |
| EP | 0 653 900 | | 5/1995 |
| EP | 0 768 809 | | 4/1997 |
| EP | 1 081 436 | | 3/2001 |
| EP | 1 120 606 | | 8/2001 |
| EP | 1 215 943 | | 6/2002 |
| EP | 1 439 740 | | 7/2004 |
| EP | 1 580 488 | | 9/2005 |
| EP | 1 615 471 | | 1/2006 |
| EP | 1 640 666 | | 3/2006 |
| EP | 1 640 667 | | 3/2006 |
| EP | 1 640 668 | | 3/2006 |
| EP | 1 698 832 | | 9/2006 |
| EP | 2 057 417 | | 5/2009 |
| EP | 2 066 974 | | 6/2009 |
| FR | 2 609 159 | | 7/1988 |
| FR | 2 655 132 | | 5/1991 |
| FR | 2 773 209 | | 7/1999 |
| GB | 1 165 535 | | 10/1969 |
| GB | 2 237 487 | | 5/1991 |
| JP | 58-000023 | | 1/1983 |
| JP | 58-213122 | | 12/1983 |
| JP | 58-214722 | | 12/1983 |
| JP | 59-044530 | | 3/1984 |
| JP | 59-060128 | | 4/1984 |
| JP | 59-071928 | | 4/1984 |
| JP | 60-042515 | | 3/1985 |
| JP | 60-042516 | | 3/1985 |
| JP | 60-223918 | | 11/1985 |
| JP | 61-165525 | | 7/1986 |
| JP | 63-201427 | | 8/1988 |
| JP | 64-12106 | | 1/1989 |
| JP | 64-012106 | | 1/1989 |
| JP | 01-189422 | | 7/1989 |
| JP | 2-161215 | | 6/1990 |
| JP | 3-11233 | | 1/1991 |
| JP | 03-011233 | | 1/1991 |
| JP | 04-093521 | | 3/1992 |
| JP | 05-113226 | | 5/1993 |
| JP | 7-119973 | | 5/1995 |
| JP | 07-119973 | | 5/1995 |
| JP | 08035668 | A * | 2/1996 |
| JP | 8-152140 | | 6/1996 |
| JP | 9-230805 | | 9/1997 |
| JP | 11-034763 | | 2/1999 |
| JP | 11-108360 | | 4/1999 |
| JP | 2000-161682 | | 6/2000 |
| JP | 2000-257876 | | 9/2000 |
| JP | 2001-208356 | | 8/2001 |
| JP | 2002-048346 | | 2/2005 |
| JP | 2006-207874 | | 8/2006 |
| KR | 1995-0003729 | | 2/1995 |
| KR | 1995-013440 | | 6/1995 |
| KR | 10-1997-0021987 | | 5/1997 |
| KR | 20-0139670 | | 3/1998 |
| KR | 10-1998-0057927 | | 9/1998 |
| KR | 1998-053939 | | 9/1998 |
| KR | 1998-057927 | | 9/1998 |
| KR | 1999-0030655 | | 7/1999 |
| KR | 1999-0055521 | | 7/1999 |
| KR | 20-0174144 | | 12/1999 |
| KR | 100254605 | | 2/2000 |
| KR | 1020010018754 | | 3/2001 |
| KR | 10-2001-0068546 | | 7/2001 |
| KR | 2001-0064859 | | 7/2001 |
| KR | 1020010060667 | | 7/2001 |
| KR | 10-2002-0007033 | | 1/2002 |
| KR | 10-2002-0050026 | | 6/2002 |
| KR | 2003-0092149 | | 12/2003 |
| KR | 1020040019624 | | 3/2004 |
| KR | 10-2004-0108050 | | 12/2004 |
| KR | 10-2005-0010565 | | 1/2005 |
| KR | 10-2005-0035776 | | 4/2005 |
| KR | 10-2006-0062198 | | 6/2006 |
| KR | 10-2006-0075154 | | 7/2006 |
| RU | 2 175 467 | | 10/2001 |
| RU | 2 258 328 | | 8/2005 |
| WO | WO 03/077601 | | 9/2003 |
| WO | WO2008/0026799 | | 3/2008 |

OTHER PUBLICATIONS

U.S. Office Action issued in U.S. Appl. No. 11/848,583 dated Nov. 5, 2010.

European Communication issued in EP Application No. 06823996.1 dated Jun. 25, 2010.

European Search Report issued in EP Application No. 10007344.4 dated Sep. 1, 2010.

U.S. Office Action issued in U.S. Appl. No. 11/848,620 dated Mar. 25, 2010.

European Extended Search Report issued in EP patent application No. 06823998.7 dated Mar. 3, 2010.

European Extended Search Report issued in EP patent application No. 06823992.0 dated Feb. 5, 2010.

European Extended Search Report issued in EP patent application No. 06823995.3 dated Feb. 24, 2010.

European Extended Search Report issued in EP patent application No. 06823996.1 dated Mar. 5, 2010.

U.S. Office Action issued in U.S. Appl. No. 11/848,608 dated Apr. 12, 2010.

Chinese Office Action issued in CN Patent Application No. 2006800558204 dated Jan. 22, 2010.

European Extended Search Report issued in EP patent application No. 06823999.5 dated Feb. 11, 2010.

International Search Report dated Jun. 13, 2007.

International Written Opinion dated Mar. 17, 2009.

International Search Report dated May 23, 2007.

European Search Report issued in EP Application No. 06823999.5 dated Nov. 30, 2010.

Chinese Office Action issued in Chinese Patent Application No. 200680055735.8 dated Mar. 2, 2010.

Chinese Office Action issued in Chinese Patent Application No. 200680055819.1 dated Dec. 18, 2009.

Chinese Office Action issued in Chinese Patent Application No. 200680055809.8 dated Apr. 27, 2010.

Russian Office Action issued in Russian Application No. 2009113560 dated Mar. 18, 2010.

European Search Report issued in European Patent Application No. 06823997.9 dated Apr. 20, 2010.

Russian Office Action issued in Russian Application No. 2009113560 dated Mar. 18, 2010.

Chinese Office Action issued in Chinese Patent Application No. 200680055818.7 dated May 25, 2010.

Chinese Office Action issued in Chinese Patent Application No. 200680055814.9 dated May 11, 2010.

Chinese Office Action issued in CN Application No. 201010228906.0 dated Apr. 19, 2011 (full Chinese text and full English translation).

U.S. Office Action issued in U.S. Appl. No. 11/848,541 dated Jun. 14, 2011.
Russian Office Action issued in Russian Patent Application No. 2009111886 dated Apr. 30, 2010.
Russian Office Action issued in Russian Application No. 2009113564 dated Jun. 1, 2010.
Russian Office Action issued in Russian Application No. 2009113563 dated Jun. 9, 2010.
Russian Office Action issued in Russian Application No. 2009113630 dated Jul. 1, 2010.
Russian Office Action issued in Russian Application No. 2009113583 dated Jul. 6, 2010.
European Search Report dated Jul. 21, 2009.
Supplementary European Search Report dated Jul. 24, 2009.
Russian Office Action issued in RU Application No. 2009113626 dated Jul. 29, 2010.
U.S. Office Action dated Nov. 2, 2009.
U.S. Office Action dated Oct. 23, 2009.
U.S. Office Action dated Oct. 28, 2009.
U.S. Office Action dated Oct. 22, 2009.
U.S. Office Action issued in U.S. Appl. No. 11/853,907 dated Aug. 15, 2011.
Mexican Office Action issued in MX Application No. MX/A/2009/002263 dated Sep. 26, 2011.
Russian Office Action issued in RU Application No. 2010130154 dated Oct. 27, 2011.
U.S. Office Action issued in U.S. Appl. No. 12/869,285 dated Jan. 9, 2012.
Office Action issued in MX Patent Application No. MX/A/2009/002676 received Nov. 23, 2011.
Office Action issued in MX Patent Application No. MX/A/2009/002674 received Nov. 23, 2011.

* cited by examiner

COOKING APPARATUS

This application claims benefit under 35 U.S.C. §119 from Korean Patent Application No. 10-2006-0088290, filed on Sep. 12, 2006, the entirety of which is incorporated herein by reference.

BACKGROUND

1. Field

This relates in general to a cooking apparatus and, more specifically, to a cooking apparatus that illuminates a selection device related to a cooking operation.

2. Description of the Related Art

In general, a cooking apparatus is an apparatus that cooks food by generating or transferring heat to food placed in a cooking cavity. Examples of such a cooking apparatus may include, for example, a microwave oven, a combined microwave oven and convection oven, a conventionally heated standard oven and the like.

BRIEF DESCRIPTION OF THE DRAWINGS

The embodiments will be described in detail with reference to the following drawings in which like reference numerals refer to like elements wherein.

DETAILED DESCRIPTION

Figure 1:
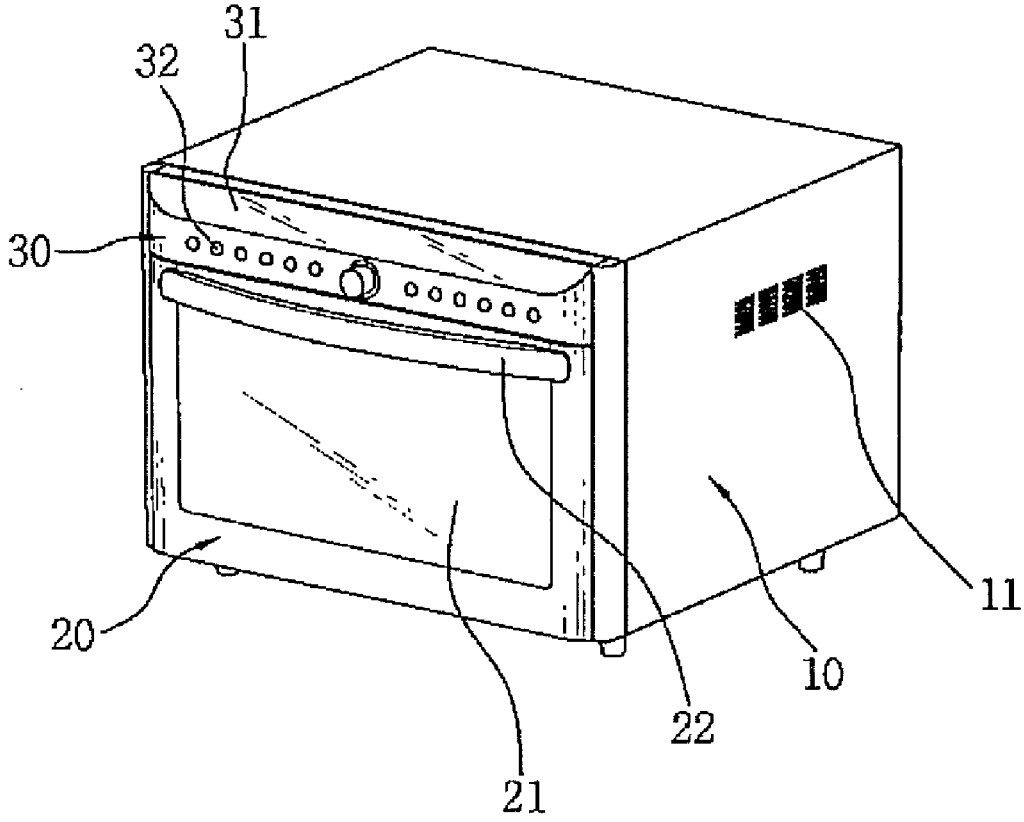
FIG. 1 is a perspective view of an exemplary cooking apparatus.

FIG. 1 is a perspective view of an exemplary cooking apparatus. The exemplary cooking apparatus may include a case 10 that defines an interior space (not shown in FIG. 1) forming a cooking cavity. A component room (not shown in FIG. 1) may be provided at upper portion of the case 10 to receive a plurality of components. A door 20 may be rotatably coupled to one side of the front surface of the case 10, with the input/display device 30 provided at the other side of the front surface of the case 10.

A turntable (not shown in FIG. 1) may be positioned in the cooking cavity inside the case 10. Food may be placed on the turntable for uniform heating during its rotation. A magnetron assembly (not shown in FIG. 1) for irradiating microwaves may be provided in the cooking cavity, and at least one heater assembly (not shown in FIG. 1) may be provided in the component room.

The lateral surfaces of the case 10 may include an inlet 11 and an outlet (not shown in FIG. 1) that communicate with the cooking cavity. When a cooling fan (not shown in FIG. 1) installed in the component room rotates, outside air may be drawn in and pass through the cooking cavity, thereby removing humidity, heat and the like as it is discharged through the outlet.

The door 20 may include a see-through window 21 such that an interior of the cooking cavity is visible therethrough. A lower end of the door 20 may be joined to the case 10 by a hinge (not shown in FIG. 1), and a handle 22 may be attached to an upper end of the door 20 to open or close the door 20.

The input/display device 30 may include a display 31 that displays an operating status of the cooking apparatus, and an input selection mechanism, such as, for example, mechanical buttons 32, through which a desired operation may be input. The input/display device 30 may be fixed to an upper portion of the case 10, as shown, for example, in FIG. 1, or in other locations on the cooking apparatus as appropriate.

By positioning the input/display device 30 at a side of the case 10, the input/display device 30 may be easily secured to the case 10, regardless of how complex its associated components may be. However, the size of the input/display device 30 is often is large and its size and position detracts from usable space and increases overall size of the cooking apparatus.

Figure 2:
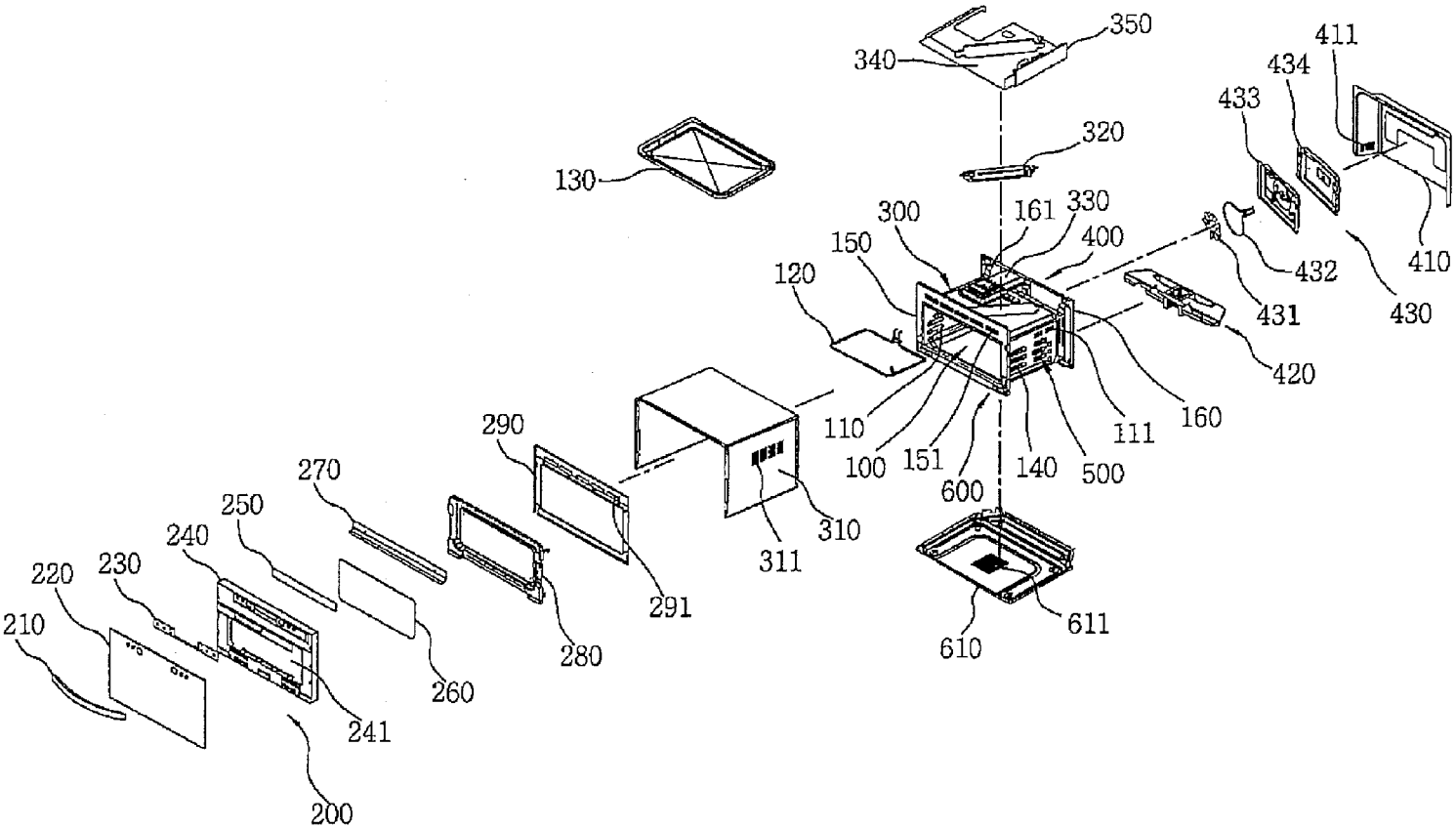
FIG. 2 is an exploded schematic view of an exemplary cooking apparatus in accordance with embodiments as broadly described herein.

FIG. 2 is an exploded view of an exemplary cooking apparatus as embodied and broadly described herein. The exemplary cooking apparatus may include a cooking cavity 100, a door 200, an upper space 300 located over the cooking cavity 100, a rear space 400 located at the rear of the cooking cavity 100, lateral spaces 500 located on both sides of the cooking cavity 100, and a lower space 600 located under the cooking cavity 100.

The cooking cavity 100 is a space for cooking food, and may be defined by an inner case 110. A heater 120 may be provided at the upper portion of the inside of the cooking cavity 100, and a plate or a rack 130 may be placed inside the cooking cavity 100. The inner case 110 may include an inlet (not shown) and an outlet 111 formed on the sides for forming an air flow path that directs heat and odors from inside the cooking cavity 100 to an outside of the cooking apparatus. The heater 120 may be, for example, a sheath heater, or other such heater as appropriate. The use of a plate 130 instead of a circular turn table within the cavity 100 alters the usable width and length (depth) of the cooking cavity 100. A size of an item placed in the cavity 100 would otherwise be restricted by a turn table and its movement within the cavity 100.

A guide 140 that guides the plate 130 into the cavity 100 may be provided at one side of the cooking cavity 100, and a front frame 150 and a rear frame 160 may be respectively provided at the front and the rear of the cooking cavity 100. The front frame 150 may have an opening 151 that defines a flow path between the upper space 300 and the door 200. The rear frame 160 may also have an opening 161 at its upper side to provide for communication between the upper space 300 and the rear space 400.

The door 200 may be hinged to the cooking cavity 100 so that the door 200 can open and close the cooking cavity 100. In certain embodiments, the door 200 may be hinged to the cooking cavity 100 at corresponding lower portions thereof. Other positions for the hinge point may also be appropriate. The door 200 may extend across both the cooking cavity 100 and the upper space 300. The door 200 may include a handle 210, a front plate 220, an input sensor 230, a door panel 240, a control panel 250, a middle plate 260, a bracket 270, a door frame 280, and a choke cover 290.

The handle 210 may be used to open or close the door 200, and may be fixed to the front plate 220 by bolts or other suitable fastener (not shown). The handle 210 may have at least one channel (not shown) formed inside along its longitudinal direction such that the channel is in communication with the outside. This may reduce the total weight of the handle, and may minimize the amount of heat transferred to a user through the handle 210 from the cooking cavity 100 during cooking.

The front plate 220 may be made of a transparent material, such as, for example, glass, such that the inside of the cooking cavity 100 is visible therethrough. A display (not shown) including, for example, buttons or other such suitable indicators/activators, may be attached thereto or coated thereon, the buttons providing for selection of a cooking course or for the indication of an operating status of the cooking apparatus.

The input sensor 230 may be operably coupled to the buttons to recognize which button has been selected. If the input sensor 230 is positioned to the rear of the front plate 220, which is, for ease of discussion, made of glass, then the input sensor 230 may be, for example, a glass touch unit and serve as an electrostatic sensor. The input sensor 230 may be attached to the front plate 220 using tape or other suitable attachment mechanism. The input sensor 230 may be located at the upper portion of the door 200 facing the upper space 300 of the cooking cavity 100. This structure yields a broader cooking cavity 100 and an unobstructed view into the cooking cavity 100.

The door panel 240 receives other components such as, for example, the front plate 220, the control panel 250 and the like of the door 200, and has an opening 241 which allows the inside of the cooking cavity 100 to be viewed. Moreover, the door panel 240 may include in its lower side an outlet 242 (see FIG. 6). This outlet 242 allows cooling flow traveling along a cooling flow path extending from a cooling fan 420 to the door 200 via the upper space 300 to be discharged.

The control panel 250 may control the overall operation of the cooking apparatus based on an input received through the input sensor 230. To this end, the control panel 250 may cooperate with the input sensor 230 and a relay substrate 350 including a printed circuit board with related control circuitry, and may be fixed to the door panel 240 from the rear side of the input sensor 230. In certain embodiments, the control panel 250 may include a light-emitting source such as, for example an LED (light emitting diode), and may irradiate the light emitted from the light-emitting source to a display (not shown).

A middle plate 260 may be fixed to the door panel 240, spaced apart from the front plate 220 and the door frame 280. The middle plate 260 may block heat transfer from the cooking cavity 100 to the front plate 220 and the handle 210. The middle plate 260 may be installed at the door panel 240 so that a flow generated from the cooling fan 420 enters the door 200 via the rear space 400 and the upper space 300 and then travels between the middle plate 260 and the front plate 220 under the guidance of the bracket 270. Such a flow vents through the outlet 242 in the door panel 240.

The bracket 270 may be fixed to the door panel 240 from the rear side of the control panel 250. In this position, the bracket 270 protects the input sensor 230 and the control panel 250, each including electronic components, against heat and microwaves from the cooking cavity 100, and against the impinging flow of the cooling fan 420, and guides the flow to travel between the door panel 240 and the front plate 220. The door frame 280 may be accommodated in the door panel 240 to block leakage of microwaves to outside of the cooking apparatus.

The choke cover 290 forms a cover for the door 200 on the side of the door 200 facing the cooking cavity 100. The choke cover 290 has an opening 291 that corresponds to the opening 151 in the front frame 150. The opening 291 may be formed on the upper side of the choke cover 290. Other locations may also be appropriate, depending, for example, on the location of the opening 151 and other openings aligned therewith. In certain embodiments, the opening 291 includes a number of holes sized so as to allow cooling air to flow therethrough, while preventing food or foreign substances from getting into the door 200 while the door 200 is being opened.

The upper space 300 is a space over the cooking cavity 100 defined by an upper surface of the cooking cavity 100 and an external case 310. The upper space 300 may house a variety of components, such as, for example, a heater 320, a waveguide 330, an insulating upper plate 340, and the relay substrate 350. A lamp (not shown) for illuminating the cooking cavity 100 may also be housed in the upper space 300.

The external case 310 may have a shape that encompasses the top and both sides of the cooking cavity 100, leaving a certain space or distance therebetween, and may be connected to the front frame 150 and the rear frame 160. If necessary, the external case 310 may have an outlet 311 so that a flow having traveled around the cooking cavity 100 and the heating elements installed in the cooking apparatus can be vented to the outside.

The heater 320 may be, for example, a halogen heater. Since such a heater 320 is influenced by microwaves, unlike the heater 120 which may be in the form of a sheath heater, as previously discussed, the heater 320 may be installed at the upper side of the inner case 110 so as to provide heat downwardly into the cooking cavity 100 from above.

The waveguide 330 may extend from the rear space 400 to the upper space 300, and may provide microwaves generated from a magnetron 440 to the cooling cavity 100. To do this, a port 331 (see FIG. 3) may be provided at the upper surface of the cooking cavity 100.

The insulating upper plate 340 prevents heat generated by the heater 120 housed in the inner case 110 from transferring to the upper space 300. In certain embodiments, the insulating upper plate 340 has a shape that covers the upper portion of the cooking cavity 100 except for the heater 320 and the waveguide 330.

The relay substrate 350 may be mounted on the insulating upper plate 340 at one side of the upper space 300. The relay substrate 350 works with the control panel 250 to operate various components, including the magnetron 440 provided in the rear space 400.

Figure 3:
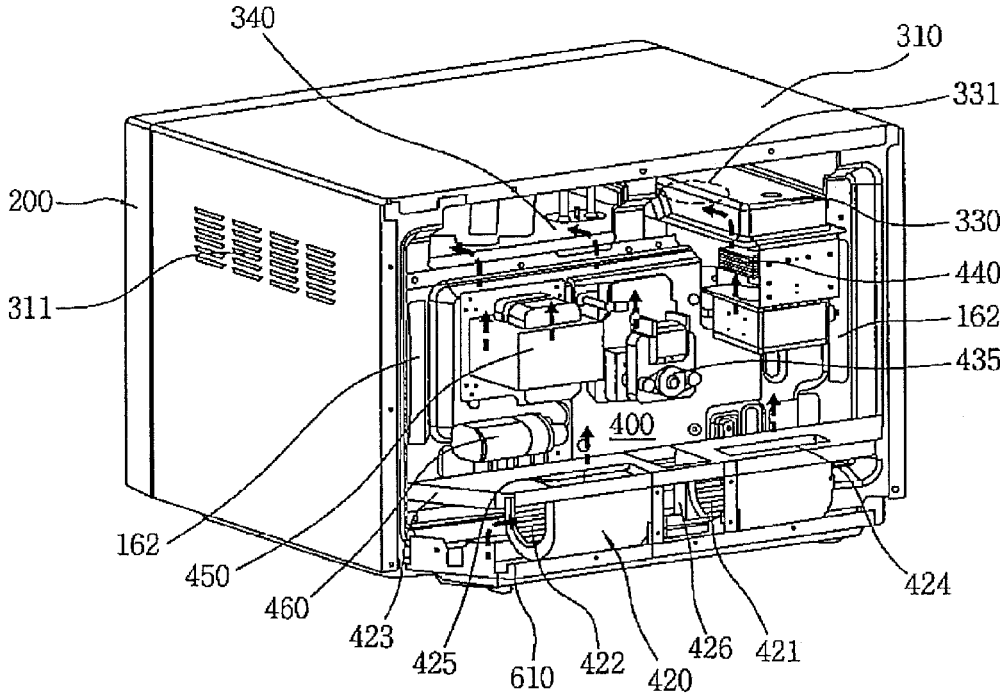
FIG. 3 is a view of a rear space of the exemplary cooking apparatus shown in FIG. 2, in accordance with embodiments as broadly described herein.

FIG. 3 is a view of an exemplary rear space of a cooking apparatus in accordance with embodiments as broadly described herein. The rear space 400 is a space behind the cooking cavity 100 defined by a rear surface of the cooking cavity 100, the rear frame 160, and a cover 410. The rear space 400 may house various components, such as, for example, a cooling fan 420, a convection heater assembly 430, and heating elements such as, for example, a magnetron 440, a high voltage transformer 450, and a high voltage capacitor 460, thus building a component room of the cooking apparatus.

The cover 410 may be connected to the rear frame 160 or the outer case 310 so as to cover the upper space 300 and the rear space 400, and its lower portion may be connected to a base 610. An inlet 411 may be provided, for example, at the lower portion of the cover 410 or the base 610 to allow for air inflow into the cooling fan 420.

The cooling fan 420 may be located at the lower portion of the rear space 400. In certain embodiments, the cooling fan may be oriented, for example, along a width direction of the rear space 400. However, other positions and orientations may also be appropriate based on the placement of various other components in the rear space 400. The cooling fan 420 may include flow-generators 421 and 422 on both sides to cool the components installed above the cooling fan 420. As the rear space 400, the upper space 300 and the door 200 are built so as to maintain communication therebetween, the entire area of the cooking apparatus can be cooled by the cooling fan 420. The cooling fan 420 may also include a partition wall 423 for preventing the flow generated by the cooling fan 420 from flowing back to the cooling fan 420. The partition wall 423 may have openings 424 and 425 provided, for example, on both sides so as to direct the flow up towards the upper portion of the rear space 400. A motor (not shown) for driving the flow-generators 421 and 422 may be provided in a space 426 between the flow generators 421 and 422.

The convection heater assembly 430 may include a fan 431, a heater 432, an inner heater cover 433, an outer heater cover 434, and a motor 435. A heat insulating material (not shown) may be placed between the inner heater cover 433 and the outer heater cover 434. Adequate space may be provided in the rear space 400, and, in particular, adequate depth, to accommodate the motor 435 and its rearward protrusion into the rear space 400. By structuring the cooking apparatus as shown, for example, in FIGS. 2 and 3, the larger volume of the rear space 400 can accommodate the major components used in the operation of the cooking apparatus, such as, for example, the heater assembly 430, the magnetron 440, the transformer 450, the capacitor 460, and the like, and the cooking cavity 100 can be expanded in the lateral and vertical directions. Also, by using a plate 130 instead of a turntable, full use may be made of the height, width and depth of the cooking cavity 100.

Additionally, by positioning the cooling fan 420 at the lower portion of the rear space 400, the rear space 400 may be more fully utilized, while still cooling the magnetron 440, transformer 450, capacitor 460, and other such components.

Also, by positioning the cooling fan 420 at the lower portion of the rear space 400 and providing for communication between the rear space 400, the upper space 300, the door 200, the cooking cavity 100, and the lateral spaces 500, essentially all parts of the cooking apparatus can be effectively cooled by the cooling fan 420. Further, as the cooling fan 420 is installed along the width direction of the rear space 400, the heating elements such as, for example, the convection heater assembly 430, the magnetron 440, the high voltage transformer 450, and the high voltage capacitor 460, which are provided in the rear space 400, can be cooled effectively. Further, flow can be communicated to the upper space 300, the lateral spaces 500 and the cooking cavity 100 and be vented through an outlet 611 formed on the base at the lower portion of the cooking cavity 100. The partition wall 423 and the openings 424 and 425 form a flow path that directs cooling air flow across the various heating elements, effectively and selectively.

The rear frame 160 may include an opening 162 which enables a direct air flow from the rear space 400 to the lateral space 500 and directs air flow to both sides of the rear space 400, thereby directing cooling air flow onto both sides of the rear space 400.

The magnetron 440, the high voltage transformer 450, and the high voltage capacitor 460 are major components used in the operation of this exemplary cooking apparatus. Each of these components generates a significant amount of heat. Thus, the magnetron 440 may be placed above the opening 424, while the high voltage transformer 450 and the high voltage capacitor 460 may be placed above the opening 425, as shown, for example, in FIG. 3, to provide for adequate cooling of these components. Other arrangements of these heating elements may also be appropriate, based on the positioning of the cooling components. Likewise, the cooling components may be rearranged based on the positioning of the heating components that require cooling.

The lateral spaces 500 are spaces on both sides of the cooking cavity 100 defined by the lateral sides of the cooling cavity 100 and the outer case 310. The lateral spaces 500 are in communication with the upper space 300, the rear space 400, and the lower space 600, and also with the cooking cavity 100, through the inlet 112 and the outlet 111. The flow generated from the cooling fan 420 travels from the rear space 400, the upper space 300, the cooking cavity 100, the lateral spaces 500, and eventually to the lower space 600. The flow traveling through the upper space 300 and heading to the lateral spaces 500 can guide flow as it exits the cooking cavity 100 through the outlet 111 to the lower space 600.

The lower space 600 is a space below the cooking cavity 100 defined by a bottom of the cooking cavity 100 and the base 610. The base 610 may be connected to the front frame 150 and the rear frame 160 to support the cooking apparatus, and includes the outlet 611 for discharge of flow originated at the cooling fan 420, as well as odors and heat generated in the cooking cavity 100. Although the rear side of the lower space 600 may be partially defined by the rear frame 160, the base 610 is connected to the cover 410 over the rear frame 160. Therefore, the base 610 also defines a portion (the lower portion) of the rear space 400. The outlet 611 may be in a number of different positions, including to the side of the outlet 111, or at the center of the base 610, as necessary to define a sufficiently long flow path. Since hot air flow is vented through the outlet 611, a plate (not shown) may be connected to the base 610 at a distance so that heat may be exhausted in lateral directions to protect a surface on which the cooking apparatus is positioned that may be sensitive to heat. Additional details regarding the flow of cooling air in and around the cooking cavity 100 are set forth in co-pending U.S. application Ser. No. 10/848,620, the entirety of which is incorporated herein by reference.

Figure 4:
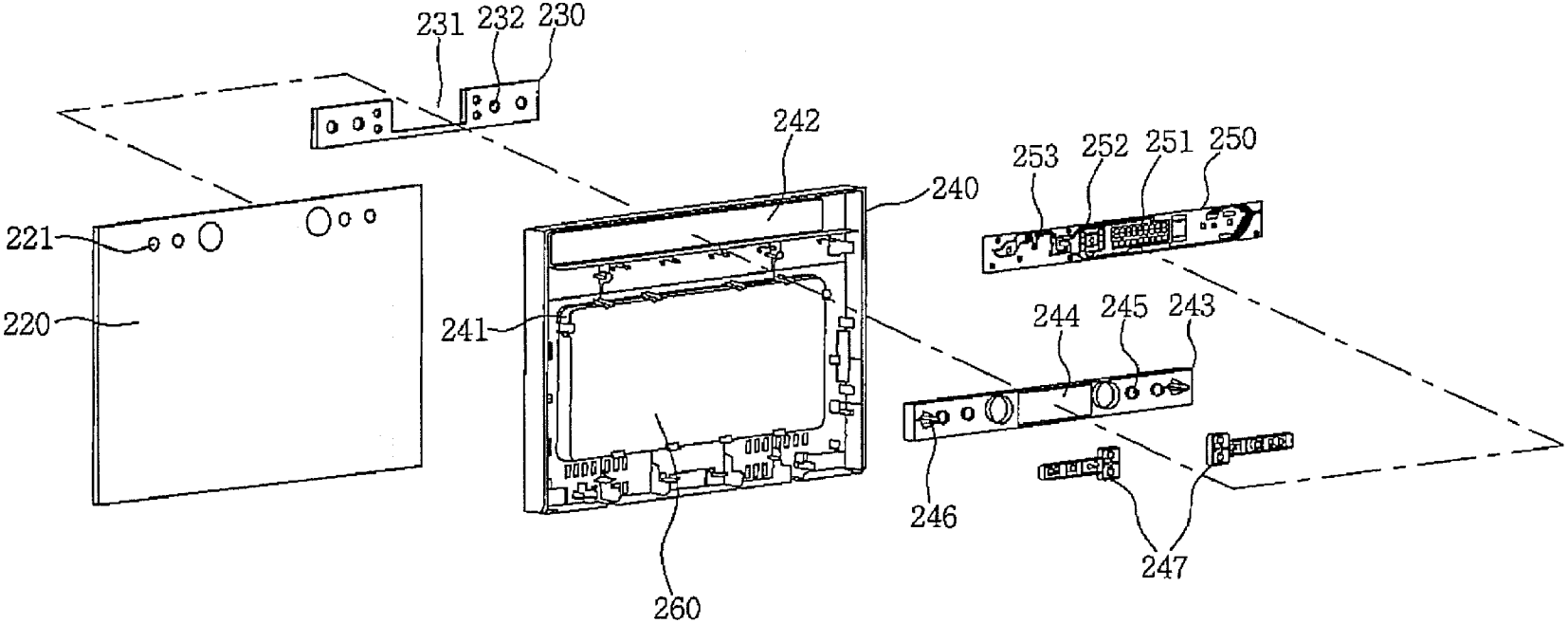
FIG. 4 is an exploded view of a selection device for the exemplary cooking apparatus shown in FIG. 2, in accordance with embodiments as broadly described herein.
Figure 5:
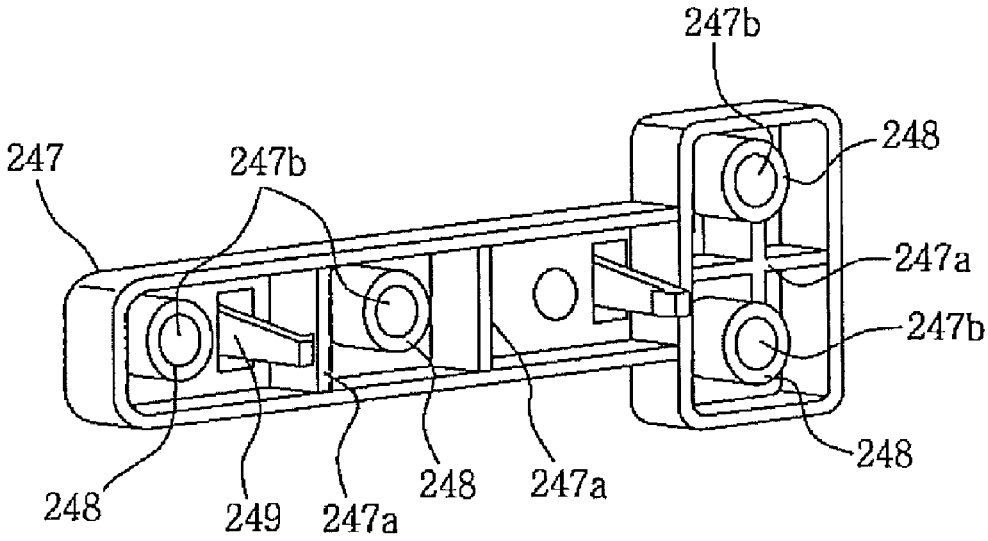
FIG. 5 is a perspective view of a wire guide for the exemplary cooking apparatus shown in FIG. 2, in accordance with embodiments as broadly described herein.

An illuminated input structure provided with the door 200 is shown in FIGS. 4 and 5.

The front plate 220 may include a space to accommodate a display window. This space may be at an upper central portion of the front plate 220, as shown in FIG. 4. Other positions may also be appropriate. A display unit 221 may be printed or coated in form of pattern, such as, for example, a button pattern, or adhered to the front plate 220.

The input sensor 230 may be a thin substrate having an electrostatic sensor, and may be adhered to the front plate 220, to the rear of the display unit 221, by a tape or adhesive or other suitable attachment mechanism. The input sensor 230 may include an opening 231 positioned corresponding to the display window, and light-passing holes 232 formed on both sides thereof corresponding to the position of the display unit 221.

The door panel 240 may include a mounting portion 242 located over the opening 241. The mounting portion 242 may be formed as an opening smaller than the opening 241. A fixing panel 243 that couples the control panel 250 to the door panel 240 may be provided on the mounting portion 242.

The fixing panel 243 may include an opening 244 positioned corresponding to the display window, light-passing holes 245 provided on opposite sides of the opening 244 corresponding to the position of the display unit 221, and fixing projections 246 provided on opposite sides, each protruding back from the rear surface to allow the control panel 250 to be connected thereto.

The control panel 250 may be a substrate that includes a display 251 that displays an operating status of the cooking apparatus. This status may include, for example, cooking temperature, cooking time, and the like. The control panel 250 may also include light-emitting sources 252 such as, for example, LEDs (light emitting diodes) positioned corresponding to the display unit 221. The control panel 250 may be fixed to the fixing projections 246 of the fixing panel 243 by screws (not shown) or other suitable fastener.

A guide 247 that gathers and transfers light may be positioned between the fixing panel 243 and the control panel 250. The guide 247 may have a plate shape, and may have openings 247*b* corresponding to each light-emitting source 252 and a cylindrical light-gathering unit 248 protruding back along the rim of each of these openings. The guide 247 may include a fixing member 249 that couples the guide 247 to the control panel 250. In certain embodiments, the fixing member 249 may be formed as a hook that may be inserted into hook holes 253 formed in the control panel 250, at a side of the light-gathering unit 248. The guide 247 may also include reinforcing ribs 247*a* that protrude backward to reinforce the strength of the guide 247.

The size of the rear end of the light-gathering unit 248 may be adjusted to correspond to the size of the light-emitting source 252, while the size of the front end of the light gathering unit 248 may be adjusted to correspond to the size of the button display unit 221, the hole 232 of the input sensor 230 or the hole 245 of the fixing panel 243 as appropriate.

Employing this structure, the fixing panel 243 may be positioned on the mounting portion 242 of the door panel 240, the input sensor 230 may be adhered to the front plate 220, and the front plate 220 may be mounted on the front side of the door panel 240. The fixing members 249 of the guide 247 may be inserted into the hook holes 253 of the control panel 250 so that the guide 247 can be coupled to the control panel 250. The control panel 250 and guide 247 may then be positioned on and coupled to the rear surface of the fixing panel 243 using the fixing projections 246.

A cooking apparatus as embodied and broadly described herein has a light-emitting source on an opposite side of a button, and a guide between the button and the light-emitting source that guides light in a prescribed direction. This improved design allows the button to be brightly illuminated.

Additionally, in a cooking apparatus as embodied and broadly described herein, even though the button is provided at the door, the button works in cooperation with a thin input sensor which is operated by touch and a control panel that includes a light-emitting source. Therefore, these components can be installed in a limited space, with the illuminated button display occupying a smaller space.

Further, in a cooking apparatus as embodied and broadly described herein, even though an input sensor operated by touch is installed between a button provided at a door and a light-emitting source provided at a control panel with overlap therebetween, the button can easily be illuminated by forming an opening in the input sensor through which the light can pass.

In one embodiment, a cooking apparatus has a button or a button display unit at the door and capable of illuminating the button brightly.

In another embodiment, a cooking apparatus is capable of illuminating buttons although the buttons are provided at the door.

In another embodiment, a cooking apparatus is capable of illuminating buttons although the operation of the buttons is made by the touch of the user.

In certain embodiments, there is provided a cooking apparatus, including a cooking cavity, a door for opening and closing the cooking cavity and including a button, an input sensing unit sensing an input from the button, a light-emitting source located at the opposite side of the button with respect to the input sensing unit and a guide located between the input sensing unit and the light-emitting source and guiding light generated by the light-emitting source to the button.

In alternative embodiments, the door is provided with a control panel mounting the light-emitting source and communicating with the input sensing unit.

In alternative embodiments, the button is formed of a button pattern provided at the door and the input sensing unit is means for sensing a touch on the button pattern by a user.

In alternative embodiments, the door is provided with a front plate on which the button and the input sensing unit are mounted.

In alternative embodiments, the input sensing unit is provided with an opening through which the light generated by the light-emitting source is guided to the button.

In alternative embodiments, the guide is provided with a fixing member to fix the guide to the control panel.

In alternative embodiments, the guide is provided with a light-gathering unit having a shape adjusted to the size of the light source at the side of the light-emitting source and adjusted to the size of the button at the side of the button.

In alternative embodiments, there is provided with a cooking apparatus, comprising: a cooking cavity; and a door for opening and closing the cooking cavity and including a door panel, a glass mounted on the door panel at the opposite side of the cooking cavity, a button pattern provided to the glass, a glass touch unit sensing a touch on the button pattern by a user, a control panel cooperating with the glass touch unit and provided with a light-emitting source, a guide located between the glass touch unit and the control panel and guiding light generated by the light-emitting source to the button pattern.

In alternative embodiments, the glass touch unit is provided with an opening so that the light generated by the light-emitting source can be guided to the button pattern.

It will be apparent to those skilled in the art that various modifications and variations can be made to the embodiments as broadly described herein. Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although a number of illustrative embodiments have been described, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking apparatus, comprising:

a cooking cavity; and a door that opens and closes the cooking cavity, wherein the door comprises:

a selector;

an input sensor having a hole formed therein, wherein the input sensor senses an input from the selector;

a light-emitting source positioned at an opposite side of the selector with respect to the input sensor; and a guide positioned between the input sensor and the light-emitting source, wherein the guide guides light generated by the light-emitting source to the hole formed in the input sensor, and the hole guides the light to the selector.

2. The cooking apparatus of claim 1, wherein the door further comprises a control panel that receives the light-emitting source, wherein the control panel is operably coupled to the input sensor.

3. The cooking apparatus of claim 2, wherein the guide includes a fixing member that couples the guide to the control panel.

4. The cooking apparatus of claim 1, wherein the selector comprises a button pattern provided on the door, and wherein the input sensor senses a touch on the button pattern.

5. The cooking apparatus of claim 4, wherein the button pattern comprises a plurality of buttons each corresponding to a respective operational function of the cooking apparatus.

6. The cooking apparatus of claim 1, wherein the door further comprises a front plate, wherein the selector and the input sensor are provided on the front plate.

7. The cooking apparatus of claim 1, wherein the guide includes a light-gathering unit, wherein a shape of a first end of the light-gathering unit corresponds to a shape of the light-emitting source, and a shape of a second end of the light-gathering unit corresponds to a shape of the selector.

8. The cooking apparatus of claim 1, wherein the guide comprises:

a main body;

a plurality of openings formed in the main body;

a corresponding plurality of light gathering units extending outward from the plurality of openings; and at least one reinforcement rib extending outward from the main body.

9. The cooking apparatus of claim 8, wherein the plurality of openings in the main body correspond to a plurality of openings formed in the input sensor, and wherein the plurality of openings in the input sensor correspond to a button pattern that forms the selector.

10. The cooking apparatus of claim 9, wherein the plurality of light gathering units guide light generated by the light-emitting source through the plurality of openings in the main body and the plurality of openings in the input sensor so as to illuminate the button pattern.

11. The cooking apparatus of claim 1, wherein the cooking apparatus is a microwave oven or a combination microwave/convection oven.

12. A cooking apparatus, comprising:

a cooking cavity; and a door that opens and closes the cooking cavity, wherein the door comprises:

a door panel;

a glass panel coupled to a side of the door panel opposite the cooking cavity;

a button pattern provided on the glass panel;

a touch sensor coupled to the glass panel, the touch sensor having a hole formed therein, wherein the touch sensor senses a touch on the button pattern;

a control panel operably coupled to the touch sensor, wherein the control panel includes a light-emitting source; and a guide positioned between the touch sensor and the control panel, wherein the guide guides light generated by the light-emitting source to the hole formed in the touch sensor, and the hole guides the light to the button pattern.

13. The cooking apparatus of claim 12, wherein the button pattern comprises a plurality of buttons, wherein each of the plurality of buttons corresponds to a cooking related function of the cooking apparatus.

14. The cooking apparatus of claim 13, wherein the guide comprises:

a main body;

a plurality of openings formed in the main body;

a corresponding plurality of light gathering units extending outward from the plurality of openings; and at least one reinforcement rib extending outward from the main body.

15. The cooking apparatus of claim 14, wherein the plurality of light gathering units extend between the light-emitting source and the button pattern so as to concentrate light emitted by the light-emitting unit onto each of the plurality of buttons.

16. The cooking apparatus of claim 12, wherein the cooking apparatus is a microwave oven or a combination microwave/convection oven.

17. A cooking apparatus, comprising:

a cooking cavity; and a door rotatably coupled to the cooking cavity, wherein the door comprises:

a door panel;

a control panel coupled to a first side of the door panel;

a front panel coupled to a second side of the door panel opposite the first side;

a selector provided on the front panel;

an input sensor provided between the selector and the door panel, and operably coupled to the control panel, wherein the input sensor includes a plurality of holes formed therein; and a guide that directs light generated at the control panel through the plurality of holes formed in the input sensor and to the selector so as to illuminate a plurality of selection devices provided on the selector.

18. The cooking apparatus of claim 17, wherein the guide comprises:

a main body;

a plurality of openings formed in the main body;

a corresponding plurality of light gathering units extending outward from the plurality of openings; and at least one reinforcement rib extending outward from the main body.

19. The cooking apparatus of claim 18, wherein the plurality of openings in the main body correspond to the plurality of holes formed in the input sensor, and wherein the plurality of holes formed in the input sensor correspond to the plurality of selection devices of the selector, and wherein the plurality of light-gathering units guide the light generated at the control panel through the plurality of openings in the main body and the plurality of holes in the input sensor so as to illuminate the plurality of selection devices.

* * * * *